US007922451B1

(12) United States Patent
Liang

(10) Patent No.: US 7,922,451 B1
(45) Date of Patent: Apr. 12, 2011

(54) TURBINE BLADE WITH BLADE TIP COOLING PASSAGES

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 880 days.

(21) Appl. No.: 11/900,033

(22) Filed: Sep. 7, 2007

(51) Int. Cl.
*F01D 5/08* (2006.01)

(52) U.S. Cl. ..... 416/97 R; 416/97 A; 415/115; 415/173.4; 415/173.5

(58) Field of Classification Search ..... 415/115, 415/173.1, 173.4, 173.5; 416/90 R, 92, 96 R, 416/96 A, 97 R, 97 A
See application file for complete search history.

(56) References Cited

U.S. PATENT DOCUMENTS

| | | | | |
|---|---|---|---|---|
| 3,899,267 | A | 8/1975 | Dennis et al. | |
| 4,142,824 | A | 3/1979 | Andersen | |
| 4,487,550 | A | 12/1984 | Horvath et al. | |
| 4,589,823 | A | 5/1986 | Koffel | |
| 4,893,987 | A | 1/1990 | Lee et al. | |
| 5,192,192 | A * | 3/1993 | Ourhaan | 416/97 R |
| 5,403,158 | A * | 4/1995 | Auxier | 416/97 R |
| 5,564,902 | A | 10/1996 | Tomita | |
| 5,660,523 | A | 8/1997 | Lee | |
| 5,733,102 | A | 3/1998 | Lee et al. | |
| 6,190,129 | B1 | 2/2001 | Mayer et al. | |
| 6,224,336 | B1 * | 5/2001 | Kercher | 416/97 R |
| 6,224,337 | B1 | 5/2001 | Lieland et al. | |
| 6,461,108 | B1 | 10/2002 | Lee et al. | |
| 6,527,514 | B2 | 3/2003 | Roeloffs | |
| 6,602,052 | B2 | 8/2003 | Liang | |
| 6,837,687 | B2 | 1/2005 | Lee et al. | |
| 7,192,250 | B2 | 3/2007 | Boury et al. | |

* cited by examiner

*Primary Examiner* — Igor Kershteyn
(74) *Attorney, Agent, or Firm* — John Ryznic

(57) ABSTRACT

A turbine blade for use in an industrial gas turbine engine, the blade having a squealer pocket with a plurality of discrete curved cooling channels to cool the blade tip and to reduce the hot gas flow leakage across the tip. The curved cooling channels include a side wall cooling channel, a tip rail crown cooling channel and an inner tip rail wall cooling channel all discharging cooling air from a cooling supply channel within the airfoil. Both the pressure side and suction side tip rails include this arrangement of cooling channels.

17 Claims, 5 Drawing Sheets

TURBINE BLADE WITH BLADE TIP COOLING PASSAGES

BACKGROUND OF THE INVENTION

1. Field of the Invention

The present invention relates generally to a turbine rotor blade, and more specifically to a turbine rotor blade with a squealer tip.

Description of the Related Art including information disclosed under 37 CFR 1.97 and 1.98

In a gas turbine engine, especially an industrial gas turbine engine, the turbine section includes a plurality of stages of turbine rotor blades with blade tips that from a gap with an outer shroud of the engine in which the hot gas flow passing through the turbine can leak past the blade tips. The blade tip gap leakage not only reduces the efficiency of the turbine by not impacting all of the gas flow onto the turbine rotor blades, but can cause thermal damage to the blade tips and result in shortened life for the blades.

In a high temperature turbine blade tip section, the heat load is a function of the blade tip leakage flow. A high leakage flow will induce a high heat load onto the blade tip section. High heat loads on the blade tip can cause erosion or other thermal damage to the tip that will decrease part life or decrease engine performance. Thus, blade tip section sealing and cooling must be addressed as a single problem. In the prior art, a turbine blade tip includes a squealer tip rail that extends around the perimeter of the airfoil flush with the airfoil wall and forms an inner squealer pocket. The main purpose of using a squealer tip in a blade design is to reduce the blade tip leakage and also to provide the rubbing capability for the blade.

In the prior art, blade tip cooling is accomplished by drilling holes into the upper extremes of the serpentine coolant passages from both the pressure and suction surfaces near the blade tip edge and the top surface of the squealer cavity. In general, film cooling holes are located along the airfoil pressure side and suction side tip sections and from the leading edge to the trailing edge to provide edge cooling for the blade squealer tip. In addition, convective cooling holes are also located along the tip rail at the inner portion of the squealer pocket to provide for additional cooling for the squealer tip rail. Since the blade tip region is subject to severe secondary flow field, a large quantity of film cooling holes and cooling flow is required in order for adequate cooling of the blade tip periphery.

FIG. 1 shows a prior art rotor blade squealer tip cooling design with the secondary hot gas flow migration around the blade tip section. The squealer tip pocket is formed by the pressure side and the suction side walls and the pocket floor. Film cooling holes are shown on the pressure side wall just beneath the squealer tip edge. Cooling holes are shown on the pocket floor to discharge cooling air from the internal cooling air passage and into the squealer pocket. The airflow over the blade tip flows in a vortex pattern as indicated by the arrows. FIGS. 2 and 3 shows the pressure side film cooling hole arrangement and shape of each film cooling hole opening.

The blade squealer tip rail is subject to heating from three exposed sides which are heat load form the airfoil hot gas side surface of the tip rail, heat load from the top portion of the tip rail, and heat load from the back side of the tip rail. Cooling of the squealer tip rail by means of discharge row of film cooling holes along the blade pressure side and suction side peripheral and conduction through the base region of the squealer tip becomes insufficient. This is primarily due to the combination of squealer pocket geometry and the interaction of hot gas secondary flow mixing. The effectiveness induced by the pressure film cooling and the tip section convective cooling holes becomes very limited. Also, a thermal barrier coating (TBC) is normally used in the industrial gas turbine airfoil for the reduction of blade metal temperature. However, applying the TBC around the blade tip rail without effective backside convection cooling may not reduce the blade tip rail metal temperature. FIG. 4 shows the current prior art blade tip section cooling design with a TBC applied on the outside and the inner surface of the squealer pocket. The blade tip includes a pressure side wall 11 and a suction side wall 12, a squealer tip rail 12 on both sides that forms the pocket 13, an internal cooling air supply passage 14, a TBC 15 applied to the pressure and suction side walls and to the pocket 13, a pressure side film cooling hole 16, a suction side film cooling hole 17, a pressure side cooling hole 18 in the pocket and a suction side cooling hole 19 in the pocket. Cooling air from the internal blade cooling circuit is discharged out from the four cooling holes to provide film cooling for the walls and to cool the squealer pocket.

Several prior art references disclose turbine blades with squealer tips having cooling passages to reduce the leakage and thermal effects from the hot gas flow leakage. These include U.S. Pat. No. 5,660,523 issued to Lee on Aug. 26, 1997 and entitled TURBINE BLADE SQUEALER TIP PERIPHERAL END WALL WITH COOLING PASSAGE ARRANGEMENT in which a cooling passage arrangement in the end walls surrounding the pocket. U.S. Pat. No. 4,142,824 issued to Andersen on Mar. 6, 1979 and entitled TIP COOLING FOR TURBINE BLADES discloses straight cooling passages located in the tip wall on the suction side of the blade. U.S. Pat. No. 4,487,550 issued to Horvath et al on Dec. 11, 1984 and entitled COOLED TURBINE BLADE TIP CLOSURE discloses cooling passages in both the pressure and suction side tip walls in which both are supplied with cooling air from a common inlet passage connected to the inner blade cooling passage circuit.

All of the above cited references disclose cooling passages formed within the blade tip wall to provide cooling for the wall and to discharge cooling air into the tip gas. However, these references do not change the momentum of the cooling air flowing through the cooling channels to increase the heat transfer rate coefficient, or inject the cooling air in a certain direction to limit mixing of the cooling air with the hot gas flow across the gap in order to form a well defined film sub-boundary layer on the external surface for the reduction of the external heat load onto the blade pressure and suction tip rail as does the blade tip cooling passages of the present invention.

It is therefore an object of the present invention to provide for a turbine blade tip with a cooling passage arrangement that will reduce the metal temperature of the blade tip in order to increase the part life.

It is another object of the present invention to provide for a turbine blade tip with a cooling passage arrangement that will reduce the leakage flow across the tip gap in order to increase the turbine efficiency.

It is another object of the present invention to provide for a turbine blade tip with a cooling passage that will inject the cooling air onto the tip rail wall at a smaller angle than would the prior art straight cooling holes.

BRIEF SUMMARY OF THE INVENTION

This problem associated with turbine airfoil tip edge cooling and sealing can be eliminated by the use of the discrete curved cooling channels of the present invention in to the squealer tip of the turbine blade. Discrete curved cooling channels are formed in the tip rails of the blade on the pressure side and the suction side external walls, through the tip walls and onto the tip crown, and within the squealer pocket on both sides of the pocket. These curved cooling channels are at a staggered array formation along the blade pressure and suction peripheral. The curved cooling channels are at a constant radius of curvature at the blade squealer pocket inner corner in order that the curved cooling channels can be formed by the same EDM tool having a curved hole forming probe.

Cooling air supplied form the blade inner cooling circuit is used to supply the curved cooling channels. The discrete curved cooling channels discharge the cooling air to produce a vena contractor effective flow area in the gap on the pressure side of the blade and to form a vortex flow on the backside of the suction side tip rail.

DETAILED DESCRIPTION OF THE INVENTION

A turbine rotor blade used in an industrial gas turbine engine in which the turbine blade includes a squealer tip to limit hot gas flow leakage and to cool the blade tip. The blade tip of the present invention includes a number of curved blade tip cooling passages or channels formed within the walls and the tip rail and the pocket floor to provide improved cooling effectiveness over the cited prior art references and to form a vena contractor effective flow area on the pressure side and a hot gas recirculation on the suction side to reduce the hot gas flow leakage across the gap.

Figure 1:
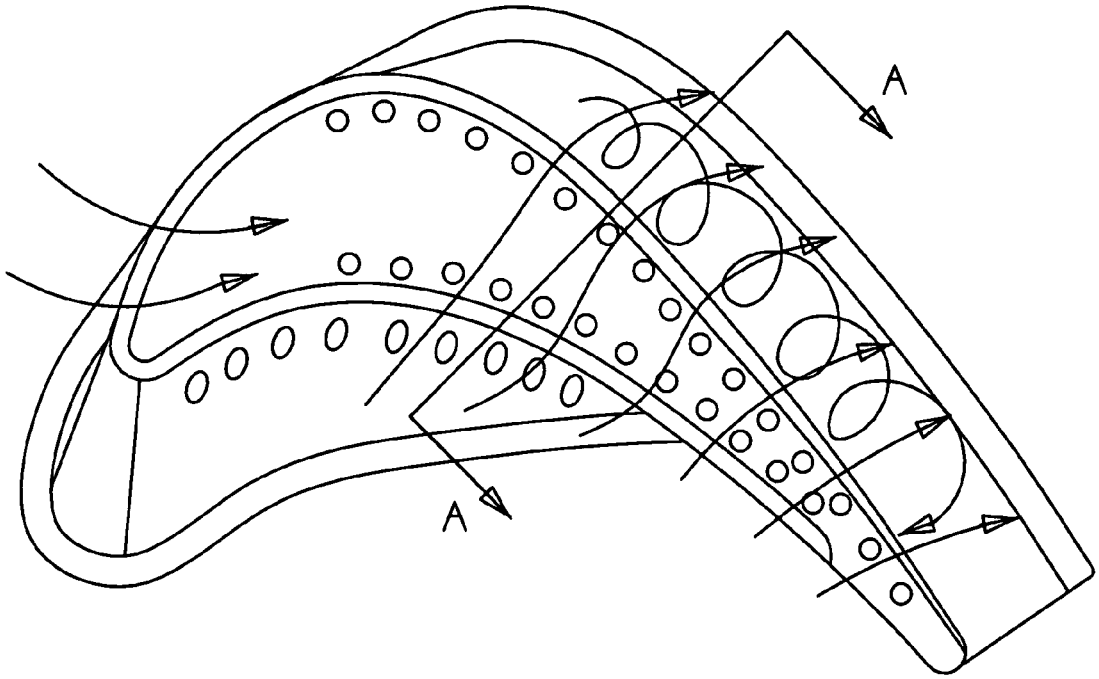
Fig 1 Prior Art
FIG. 1 shows a top view of a prior art turbine blade with a squealer tip pocket with cooling holes.
Figure 2:
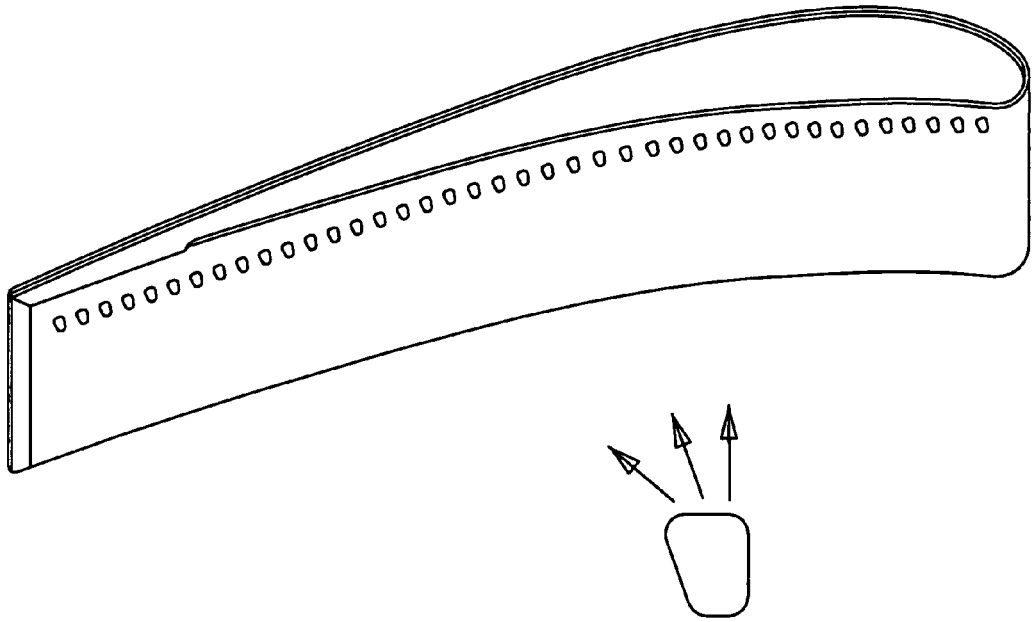
Fig 2 Prior art
FIG. 2 shows a view of the pressure side of the squealer tip of the turbine blade in the prior art FIG. 1 with the film cooling hole pattern.
Figure 3:
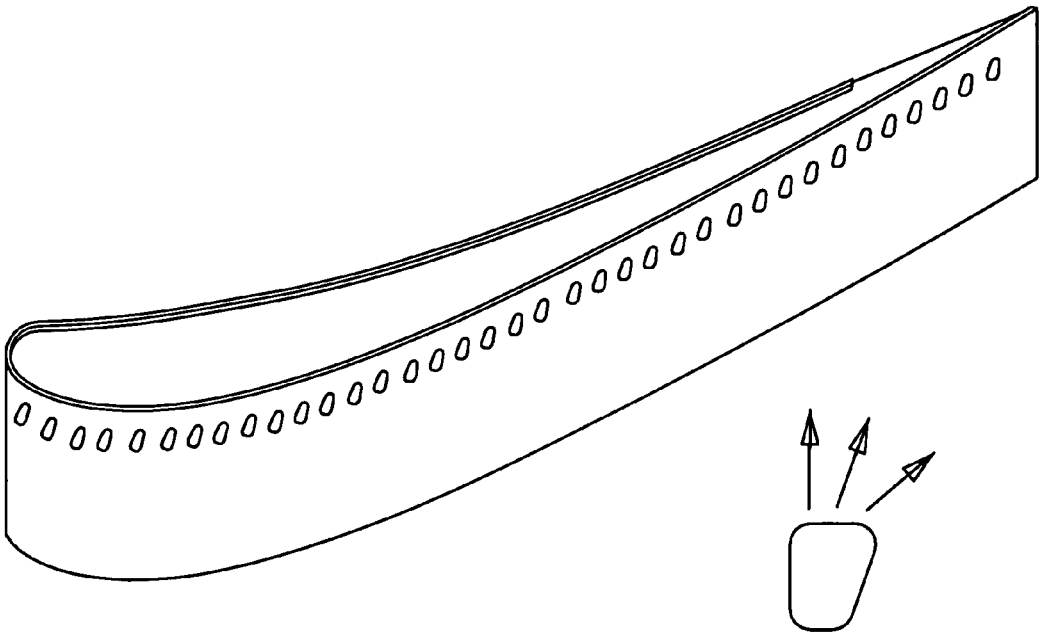
Fig 3 Prior art
FIG. 3 shows a schematic view from the suction side of the squealer tip of the turbine blade in the prior art FIG. 1 with the film cooling hole pattern.
Figure 4:
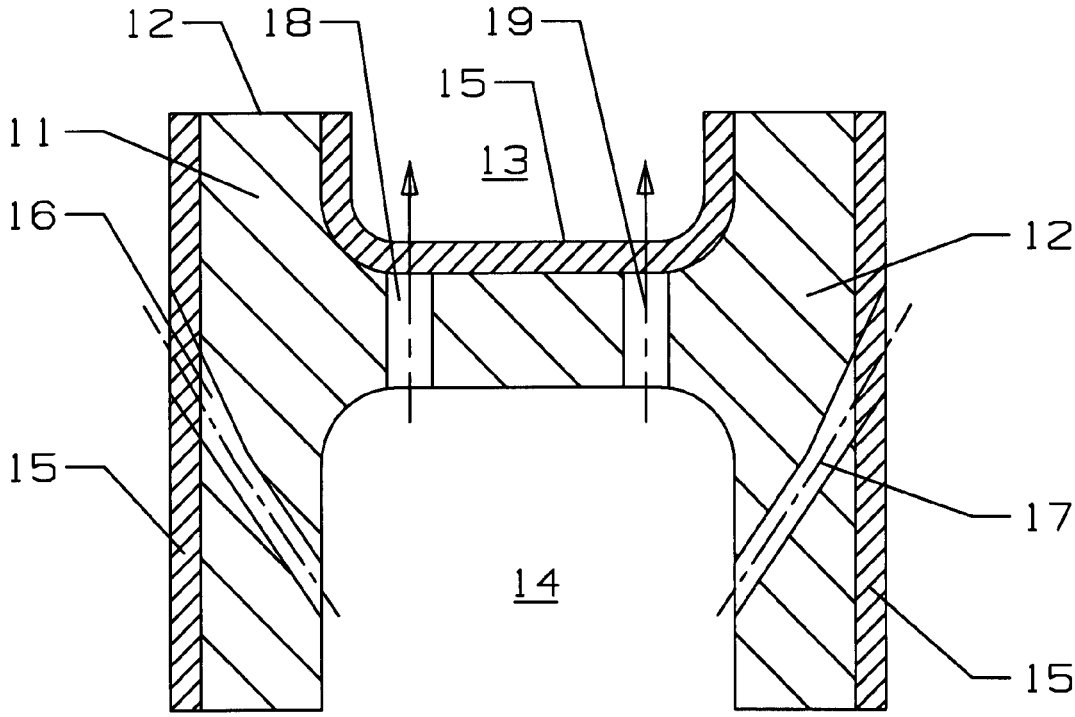
Fig 4 Prior art
FIG. 4 shows a cross section view of a prior art turbine blade with cooling passages in the squealer tip rails and the squealer pocket.
Figure 5:
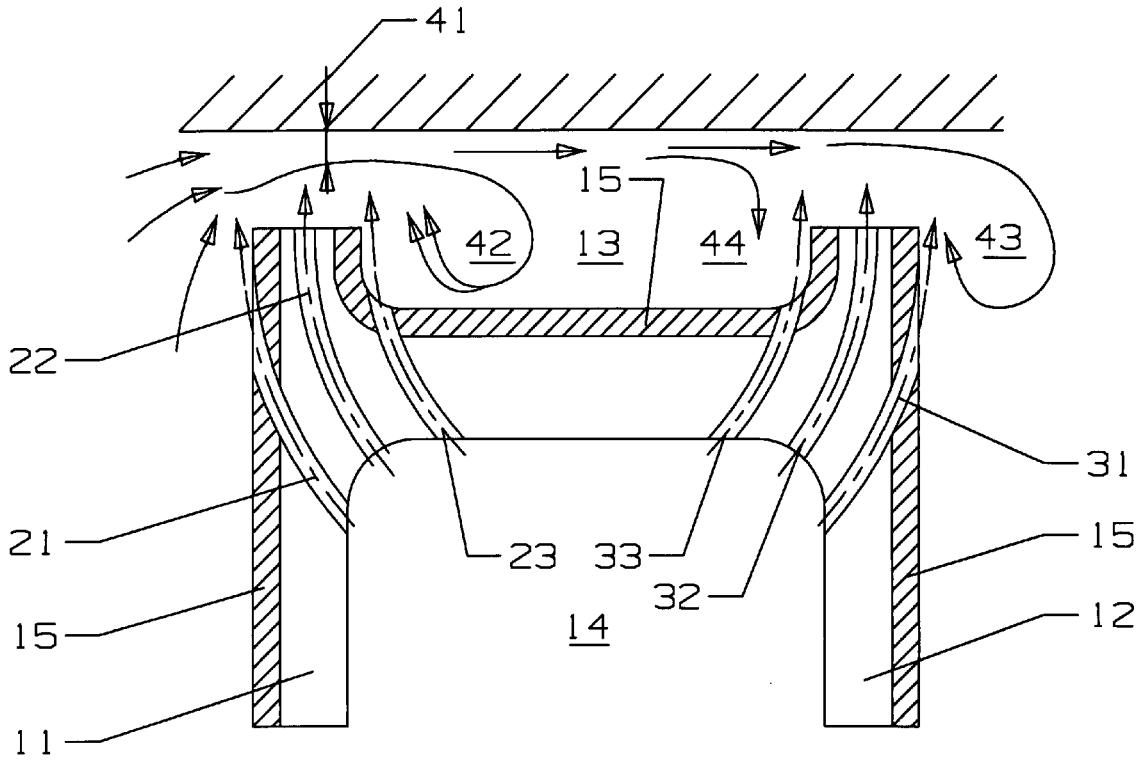
FIG. 5 shows a cross section view of the turbine blade squealer tip cooling passages of the present invention.

FIG. 5 shows a cross section view of the blade tip with the cooling passages of the present invention. the blade includes a pressure side wall 11 with a TBC 15 applied up to the tip rail, and a suction side wall 12 also with a TBC 15 applied up to the tip rail. A squealer pocket 13 is formed between the pressure side tip rail and the suction side tip rail. A cooling supply passage or cavity 14 is formed within the body of the blade and supplies cooling air to the discrete curved cooling channels formed in the blade tip region as described below. The internal cooling circuit of the blade could be a single cooling passage or a serpentine flow circuit of the prior art.

The discrete curved cooling channels of the present invention includes a pressure side wall cooling channel 21, a pressure side tip rail cooling channel 22 a pressure side pocket cooling channel 23, a suction side tip rail cooling channel 31, a suction side tip rail cooling channel 32, and a suction side pocket cooling channel 33. These curved cooling channels are at a staggered array along the blade pressure and suction peripheral. The curved channels are at a constant radius of curvature at the blade squealer pocket inner corner. The cooling channels are curved in order to discharge the cooling air out from the holes in a direction that straight holes could not for the reasons to be described below. The curved cooling holes have the same radius of curvature since all the holes are formed from the same curved tool such as an EDM tool used to produce the well known straight film cooling holes of the prior art. Instead of a straight probe to form the hole, a curved probe is used. The curved probe would be pushed through the metallic material to form the curved hole with the tool rotating along the radius of curvature to form the curved hole. In other embodiments, the curved cooling holes could have different radius of curvatures if required, but would then require a different tool for each curved hole.

Cooling air is fed into the curved cooling channels from the blade cooling cavity 14 below the pocket floor and the flows through the curved cooling channels to provide cooling for the blade tip rail. Since the cooling channels are curved, the cooling air has to change its momentum while flowing through the cooling channel which will generate a high rate of internal heat transfer coefficient within the curved channel. Also, the curved cooling channel will discharge the cooling air much closer to the airfoil wall than will the straight cooling holes of the above cited prior art references.

The pressure side wall and suction side wall external film cooling holes 21 and 31 are positioned much closely to the airfoil peripheral tip portion and below the tip crown in order that the cooling flow discharge from the film hole is in the same direction as the secondary flow over the blade tip from the pressure side wall to the suction side wall. This results in the cooling air discharged from the film cooling holes will produce very little mixing with the hot gas flow over the tip rail crows and form a well defined film sub-boundary layer on the external surface for the reduction of external heat load onto the blade pressure and suction tip rails. This creates an effective method for the cooling of the blade tip rail and reduces the blade tip rail metal temperature.

In operation, due to the pressure gradient across the airfoil from the pressure side to the suction side, the secondary flow near the pressure side surface is migrated from the lower blade span upward across the blade tip end or crown. The near wall secondary flow will follow the airfoil contour and flow upward with the discharged cooling air and against the oncoming stream-wise leakage flow. This counter flow action reduces the oncoming leakage flow as well as pushes the leakage flow outward to the blade outer air seal (BOAS). In addition to the counter flow action, it also forces the secondary flow to bend outward as the leakage enters the pressure side tip entrance corner and yields a smaller vena contractor and thus reduces the effective leakage flow area in the gap. The vena contractor 41 is reduced by the discharge cooling air from the middle curve cooling channel located on top of the tip crown. As the leakage flows through the blade pressure side tip rail, a small vortex 42 is formed at the downstream location of the tip rail. The inner cooling channel 23 will discharge the cooling air inline with the vortex flow 42 and provide additional reduction to the effective vena contractor flow area 41 as well as provide higher heat transfer cooling performance for the inner corner of the blade tip rail. The overall result from this combination of effects is a reduction of the blade leakage flow at the blade pressure side tip location. As the leakage flows through the pressure side tip, the squealer pocket in-between the airfoil pressure and suction tip rails will create a flow recirculation with the leakage flow.

On the blade suction wall tip rail, the injection of cooling air also impacts on the leakage reduction. Cooling air for the curved cooling channels located within the squealer pocket is injected into the inner fillet corner to create a counter circular flow against the vortex 44 generated by the leakage flow. The injection of cooling air into the fillet corner on the suction side tip rail will accelerate the secondary flow upward and flow against the on-coming leakage flow to push the leakage outward and toward the blade outer air seal (BOAS). The injection of cooling air will neck down the vena contractor and reduce the effective flow area. The cooling air injected on top of the suction side tip crown will block the oncoming leakage flow and further pinch the vena contractor. As a result of both cooling flow injections, the leakage flow across the blade end tip is further reduced. As the leakage flows through the suction wall end tip, a recirculation flow 43 is generated by the leakage on the upper span blade of the suction side wall. Once again, the hot gas recirculation flow will swing upward with the suction side external discharge cooling air very close to the wall and provide a well established film cooling layer for the cooling of the airfoil suction tip rail.

The discrete curved cooling channels of the present invention provides a flow resistance effect at the blade end tip sections and cooling flow injection through the blade tip section to yield a very high resistance for the leakage flow path and therefore reduces the blade leakage flow and heat load. This results in a reduction of the blade tip section cooling flow requirement which then results in an increase in the engine performance. Major advantages of the discrete curved cooling channels of the present invention over the cited prior art references are discussed below. The blade tip rail cooling channels and cooling air injection of the present invention induces a very effective blade cooling and seal for both the pressure and suction walls. A lower blade tip section cooling air demand results from a lower blade leakage flow. Higher turbine efficiency is obtained due to a low blade leakage flow. A reduction of the blade tip section heat load due to the low leakage flow will increase the blade usage life and reduce the cost of operating the engine.

I claim the following:

1. A turbine blade comprising:

a pressure side wall and a suction side wall;

a squealer tip formed by a pressure tip rail and a suction tip rail;

a squealer pocket formed between the pressure and suction tip rails, the squealer pocket having a squealer floor;

a cooling supply cavity formed within the blade;

a pressure side wall film cooling channel connected to the cooling supply cavity, the pressure side wall film cooling channel being oriented to discharge cooling air toward the pressure side tip rail crown;

a pressure side tip rail cooling channel connected to the cooling supply cavity, the pressure side tip rail cooling channel being oriented to discharge cooling air toward a gap formed between the pressure side tip rail crown and an outer shroud forming a leakage flow gap;

a pressure side pocket cooling channel connected to the cooling supply cavity, the pressure side pocket cooling channel being oriented to discharge cooling air toward the pocket side surface of the pressure side tip rail; and, the pressure side wall film cooling channel, the pressure side tip rail cooling channel, and the pressure side pocket cooling channel are each discrete curved cooling channels having a curvature in the same direction.

2. The turbine blade of claim 1, and further comprising:

the direction of curvature is toward the pocket.

3. The turbine blade of claim 2, and further comprising:

the curved cooling channels are at a substantially constant radius of curvature.

4. The turbine blade of claim 1, and further comprising:

the cooling channels are staggered along the blade pressure side peripheral.

5. The turbine blade of claim 1, and further comprising:

the pressure side pocket cooling channel is located adjacent to the pressure side tip rail.

6. The turbine blade of claim 1, and further comprising:

a suction side wall film cooling channel connected to the cooling supply cavity, the suction side wall film cooling channel being oriented to discharge cooling air toward the suction side tip rail crown;

a suction side tip rail cooling channel connected to the cooling supply cavity, the suction side tip rail cooling channel being oriented to discharge cooling air toward a gap formed between the suction side tip rail crown and an outer shroud forming a leakage flow gap; and, a suction side pocket cooling channel connected to the cooling supply cavity, the suction side pocket cooling channel being oriented to discharge cooling air toward the pocket side surface of the suction side tip rail.

7. The turbine blade of claim 6, and further comprising:

the cooling channels on the pressure side and the suction side all have substantially the same radius of curvature.

8. The turbine blade of claim 6, and further comprising:

the cooling channels are staggered along the blade pressure side peripheral.

9. The turbine blade of claim 6, and further comprising:

the pressure side pocket cooling channel is located adjacent to the pressure side tip rail; and, the suction side pocket cooling channel is located adjacent to the suction side tip rail.

10. The turbine blade of claim 1, and further comprising:

the pressure side wall film cooling channel has a discharge opening on the pressure side wall located above the pocket floor in a spanwise direction of the blade.

11. The turbine blade of claim 6, and further comprising:

the pressure and suction side wall film cooling channels both have a discharge opening on the respective side wall located above the pocket floor in a spanwise direction of the blade.

12. A turbine rotor blade comprising:

a pressure side wall and a suction side wall;

a squealer tip formed by a pressure side tip rail and a suction side tip rail;

a squealer pocket formed between the pressure side and suction side tip rails;

the squealer pocket having a squealer floor;

a cooling supply cavity formed within the blade;

a first cooling air hole connected to the cooling supply cavity and opening onto the pressure side wall just below a pressure side tip rail crown and directed to discharge film cooling air toward the pressure side tip rail crown;

a second cooling air hole connected to the cooling supply cavity and opening onto the pressure side tip rail crown; and, a third cooling air hole connected to the cooling supply cavity and directed to discharge cooling air onto an inner side surface of the pressure side tip rail.

13. The turbine rotor blade of claim 12, and further comprising:

the first and second and third cooling air holes are each curved cooling holes toward the squealer pocket.

14. The turbine rotor blade of claim 12, and further comprising:

the first and second and third cooling air holes are each discrete cooling air holes that form a continuous cooling air passage from an inlet end to an outlet end.

15. The turbine rotor blade of claim 12, and further comprising:

the first and second and third cooling air holes each discharge cooling air substantially in an upward direction of the rotor blade.

16. The turbine rotor blade of claim 12, and further comprising:

a fourth cooling air hole connected to the cooling supply cavity and opening onto the suction side wall just below a suction side tip rail crown and directed to discharge film cooling air toward the suction side tip rail crown;

a fifth cooling air hole connected to the cooling supply cavity and opening onto the suction side tip rail crown; and, a sixth cooling air hole connected to the cooling supply cavity and directed to discharge cooling air onto an inner side surface of the suction side tip rail.

17. The turbine rotor blade of claim 16, and further comprising:

the fourth and fifth and sixth cooling air holes are each curved cooling holes toward the squealer pocket.

* * * * *